US006702418B2

(12) United States Patent
Satou et al.

(10) Patent No.: US 6,702,418 B2
(45) Date of Patent: Mar. 9, 2004

(54) INK JET RECORDING DEVICE CAPABLE OF DETECTING DEFECTIVE NOZZLE WITH HIGH SIGNAL-TO-NOISE RATIO

(75) Inventors: Kunio Satou, Hitachinaka (JP); Takahiro Yamada, Hitachinaka (JP); Hitoshi Kida, Hitachinaka (JP); Shinya Kobayashi, Hitachinaka (JP); Kazuo Shimizu, Hitachinaka (JP)

(73) Assignee: Hitachi Printing Solutions, Ltd., Kanagawa-Ken (JP)

( * ) Notice: Subject to any disclaimer, the term of this patent is extended or adjusted under 35 U.S.C. 154(b) by 38 days.

(21) Appl. No.: 10/002,128

(22) Filed: Dec. 5, 2001

(65) Prior Publication Data

US 2002/0171717 A1 Nov. 21, 2002

(30) Foreign Application Priority Data

Dec. 25, 2000 (JP) ..... P2000-392512

(51) Int. Cl.[7] ..... B41J 29/393; B41J 29/38

(52) U.S. Cl. ..... 347/19; 347/14

(58) Field of Search ..... 347/19, 14, 10, 347/12, 9, 11, 8, 23, 7, 72, 20, 17, 50, 63, 64, 59, 5, 37, 6, 24; 358/461; 324/433, 426, 427; 320/15, 20

(56) References Cited

U.S. PATENT DOCUMENTS 4,439,776 A * 3/1984 Zeiler ..... 347/76
5,861,898 A * 1/1999 Nakanishi ..... 347/19
6,302,504 B1 * 10/2001 Imanaka et al. ..... 347/9

FOREIGN PATENT DOCUMENTS

JP 61-53053 3/1986

* cited by examiner

*Primary Examiner*—Raquel Yvette Gordon
*Assistant Examiner*—Charles Stewart, Jr.
(74) *Attorney, Agent, or Firm*—Whitham, Curtis & Christofferson, P.C.

(57) ABSTRACT

When positively charged ink droplets 608 from a defective nozzle impact a negatively charged deflector electrode 320, the positive charge on condenser 609 flows to the ground via a FET 618 of a photo-coupler 610. As a result, the electric discharge occurs by an amount equivalent to the charging amount of the ink droplets 608 clinging on the electrode 320. Because a switching signal 606 is "1", the ON resistance of the photo-coupler 610 is large, and the ON resistance of the FET 620 of the photo-coupler 612 is small. Accordingly, the discharge due to the charged ink droplets 608 is detected as a large detection voltage and amplified by an operational amplifier 613 . Because the charger voltage of the condenser 609 is static and has no noise, even when the detection output 615 is highly amplified, noise during the detection is suppressed.

20 Claims, 6 Drawing Sheets

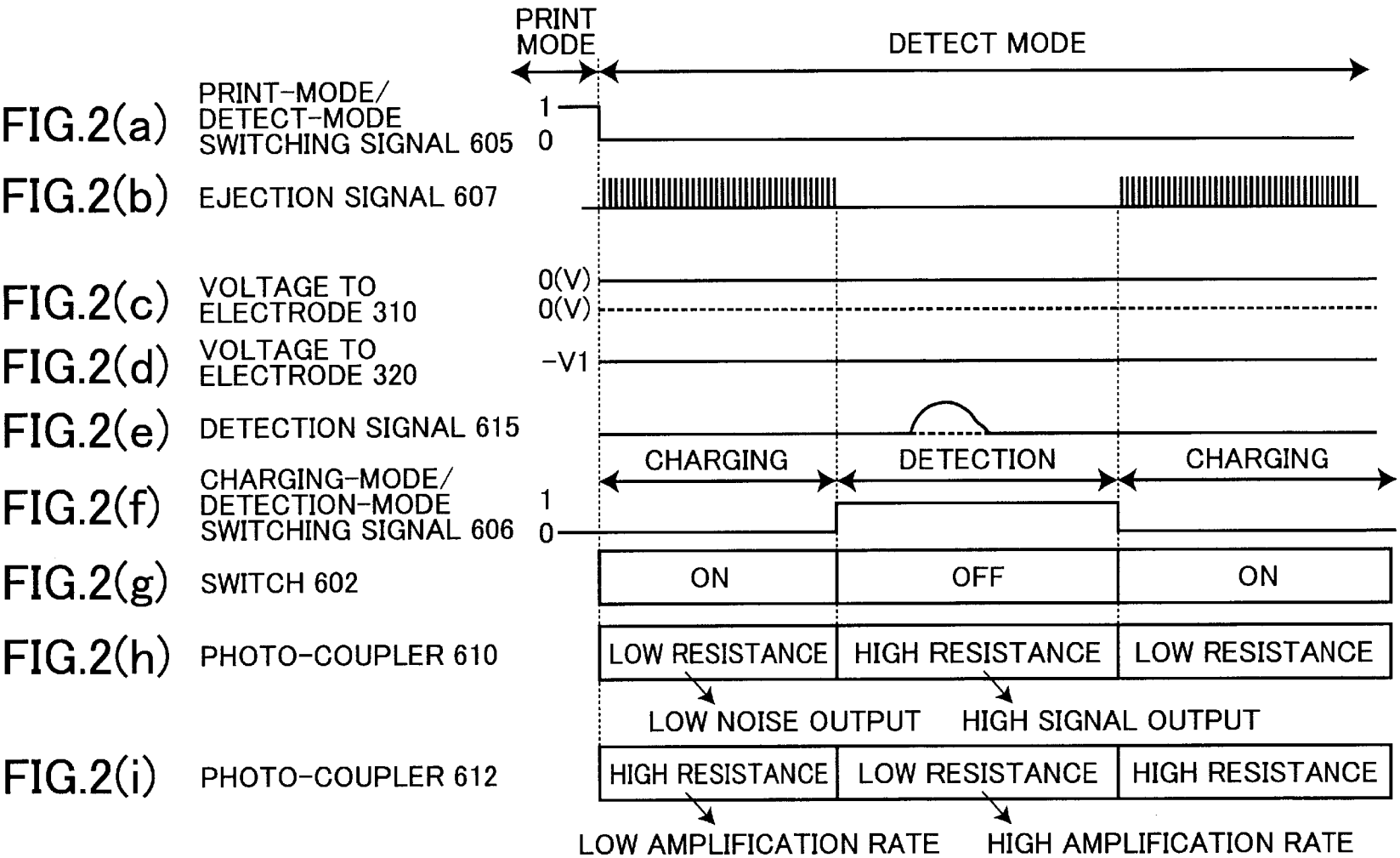
PRINT MODE
DETECT MODE
FIG.2(a) PRINT-MODE/ DETECT-MODE SWITCHING SIGNAL 605
1
0
FIG.2(b) EJECTION SIGNAL 607
FIG.2(c) VOLTAGE TO ELECTRODE 310
0(V)
FIG.2(d) VOLTAGE TO ELECTRODE 320
0(V)
-V1
FIG.2(e) DETECTION SIGNAL 615
FIG.2(f) CHARGING-MODE/ DETECTION-MODE SWITCHING SIGNAL 606
1
0
CHARGING
DETECTION
CHARGING
FIG.2(g) SWITCH 602
ON
OFF
ON
FIG.2(h) PHOTO-COUPLER 610
LOW RESISTANCE
HIGH RESISTANCE
LOW RESISTANCE
LOW NOISE OUTPUT
HIGH SIGNAL OUTPUT
FIG.2(i) PHOTO-COUPLER 612
HIGH RESISTANCE
LOW RESISTANCE
HIGH RESISTANCE
LOW AMPLIFICATION RATE
HIGH AMPLIFICATION RATE

FIG.5(a)

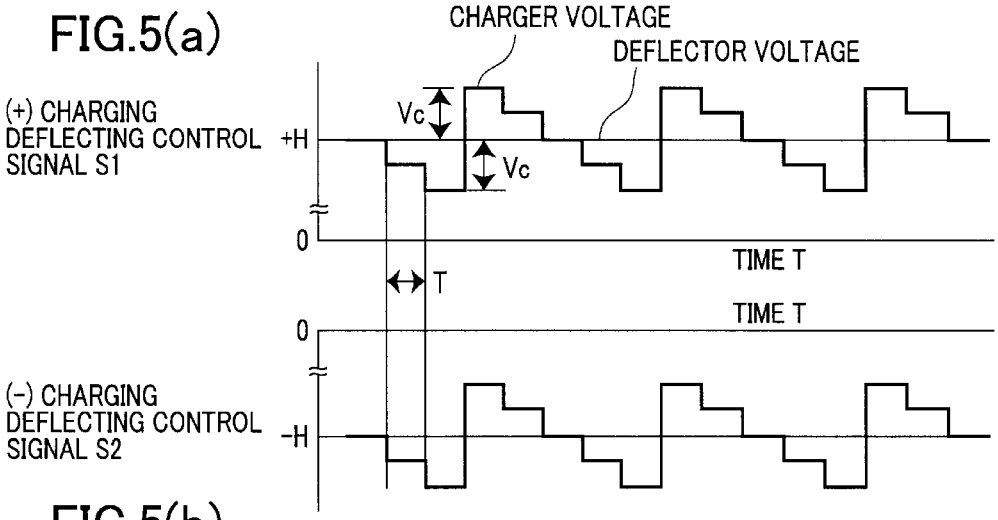

FIG.5(b)

| | T1 | T2 | T3 | T4 | T5 | T6 | T7 | T8 | T9 | T10 | T11 | T12 | T13 | T14 | T15 | T16 |
|---|---|---|---|---|---|---|---|---|---|---|---|---|---|---|---|---|
| DRIVING PULSE Sa FOR NOZZLE 230A | | | | | | | | | | | | | | | | |
| DEFLECTION AMOUNT Ca FOR NOZZLE 230A | 0 | OFF | −2 | OFF | +1 | OFF | −1 | OFF | OFF | OFF | 0 | OFF | −2 | OFF | +1 | OFF |
| DRIVING PULSE Sb FOR NOZZLE 230B | | | | | | | | | | | | | | | | |
| DEFLECTION AMOUNT Cb FOR NOZZLE 230B | OFF | −1 | OFF | OFF | OFF | 0 | OFF | −2 | OFF | +1 | OFF | −1 | OFF | OFF | OFF | 0 |
| DRIVING PULSE Sc FOR NOZZLE 230C | | | | | | | | | | | | | | | | |
| DEFLECTION AMOUNT Cc FOR NOZZLE 230C | 0 | OFF | −2 | OFF | +1 | OFF | −1 | OFF | OFF | OFF | 0 | OFF | −2 | OFF | +1 | OFF |
| DRIVING PULSE Sd FOR NOZZLE 230D | | | | | | | | | | | | | | | | |
| DEFLECTION AMOUNT Cd FOR NOZZLE 230D | OFF | −1 | OFF | OFF | OFF | 0 | OFF | −2 | OFF | +1 | OFF | −1 | OFF | OFF | OFF | 0 |

INK JET RECORDING DEVICE CAPABLE OF DETECTING DEFECTIVE NOZZLE WITH HIGH SIGNAL-TO-NOISE RATIO

BACKGROUND OF THE INVENTION

1. Field of the Invention

The present invention relates to an ink jet recording device having a monitor function for monitoring ink droplet generating conditions.

2. Related Art

There has been proposed a line scanning type ink jet printer, capable of printing images on an elongated uncut recording sheet at a high printing speed. This type of printer includes a head having a plurality of nozzles and an elongated width covering over the entire width of the recording sheet. When printing images, ink droplets are ejected from the nozzles, charged, and deflected, and then impact on the recording sheet that is being fed at a high speed in its longitudinal direction. The impact positions of the ejected ink droplets on the recording sheet are controlled based on a recording signal. By controlling the impact positions of the ink droplets and the feed of the recording sheet, a desired image is formed on the recording sheet.

There are two types of line scanning type ink jet printer. One includes a continuous ink jet head, and the other includes an on-demand ink jet head.

Although, the printer with the on-demand ink jet head is slow in printing speed compared with the printer with the continuous ink jet head, the on-demand ink jet head requires a simple ink system, and so is well suited for a general-purpose high-speed printer.

When a nozzle of ink jet printers becomes defective, a part of an image corresponding to the defective nozzle may be left out or may have an unevenness in ink density, resulting in degradation of image quality. Therefore, in order to maintain a high quality of images, it is necessary to monitor the ink ejection condition of each nozzle.

Japanese Patent-Application Publication No. SHO-61-53053 discloses an ink jet printer having a monitor function for monitoring ink droplet generation. After an ink-droplet-charging signal is generated to charge ink droplets for a certain period of time, a charged-amount-detection signal is detected for a certain period of time so as to detect charging condition of the ink droplets. A changeable amplifying means amplifies the charged-amount-detection signal at an amplification rate. An amplification-rate-control-signal generation circuit generates and outputs an amplification-rate-control signal to control the changeable amplifying means to change the amplification rate. Specifically, the amplification-rate-control signal controls the changeable amplifying means to set to a lower amplification rate when the ink-droplet charging signal is being generated, and to a higher amplification rate when the charged-amount-detection signal is being detected. In this way, the charged amount, i.e., charging condition of ink droplet, is detected while preventing a detection error, because electrical noise is not amplified other than when the charged amount-detection signal is being detected.

SUMMARY OF THE INVENTION

However, in the above printer, because a pulse-shaped high voltage signal is used as the ink-droplet charging signal, its influence is reflected in the charged-amount detection signal, which is a weak signal, so the signal-to-noise ratio (SNR) becomes small.

It is an object of the present invention to overcome the above problems, and also to provide an ink jet recording device capable of detecting the ink droplet generation condition with high SNR.

In order to achieve the above and other objective, there is provided an ink jet recording device including a head formed with a nozzle and selectively ejecting an ink droplet from the nozzle, a deflecting means for deflecting a flying direction of the ink droplet ejected from the nozzle, the deflecting means including a first electrode and a second electrode, a mode selecting means for selecting one of a first mode and a second mode, an applying means for applying a direct voltage to the first electrode and another direct voltage to the second electrode throughout the first mode and the second mode, the direct voltage differing from the another direct voltage, and a detection means for detecting a quantity of electricity relating to an electric discharge flowing through the first electrode in the second mode.

There is further comprising a control method for controlling an ink jet recording device. The control method comprises the steps of a) selecting a first mode, b) applying a direct voltage to a first electrode and another direct voltage to a second electrode throughout the first mode and a second mode, the direct voltage differing from the another direct voltage, c) ejecting an ink droplet from a nozzle of an ink jet head in the first mode, d) switching from the first mode to the second mode, and e) detecting a quantity of electricity relating to an electric discharge flowing through the first electrode.

BRIEF DESCRIPTION OF THE DRAWINGS

In the drawings:

FIG. 2(*a*) is a time chart of a print-mode/detect-mode switching signal;

FIG. 2(*b*) is a time chart of ejection signal;

FIG. 2(*c*) is a time chart of voltage applied to a first deflector electrode;

FIG. 2(*d*) us a time chart of voltage applied to a second deflector electrode;

FIG. 2(*e*) is a time chart of a detection signal;

FIG. 2(*f*) is a time chart of charging-mode/detection-mode switching signal;

FIG. 2(*g*) is a time chart of a condition of a switch;

FIG. 2(*h*) is a time chart of a condition of a photo-coupler;

FIG. 2(*i*) is a time chart of a condition of a photo-coupler;

FIG. 5(*a*) is an explanatory view showing charging-deflection control signals applied to the charger electrodes of the ink jet printer;

FIG. 5(*b*) is an explanatory view showing PZT driving signals applied to nozzles and corresponding deflection amounts of ink droplets.

PREFERRED EMBODIMENT OF THE PRESENT INVENTION

Next, an ink jet printer 1 according to an embodiment of the present invention will be described while referring to the attached drawings.

Figure 1:
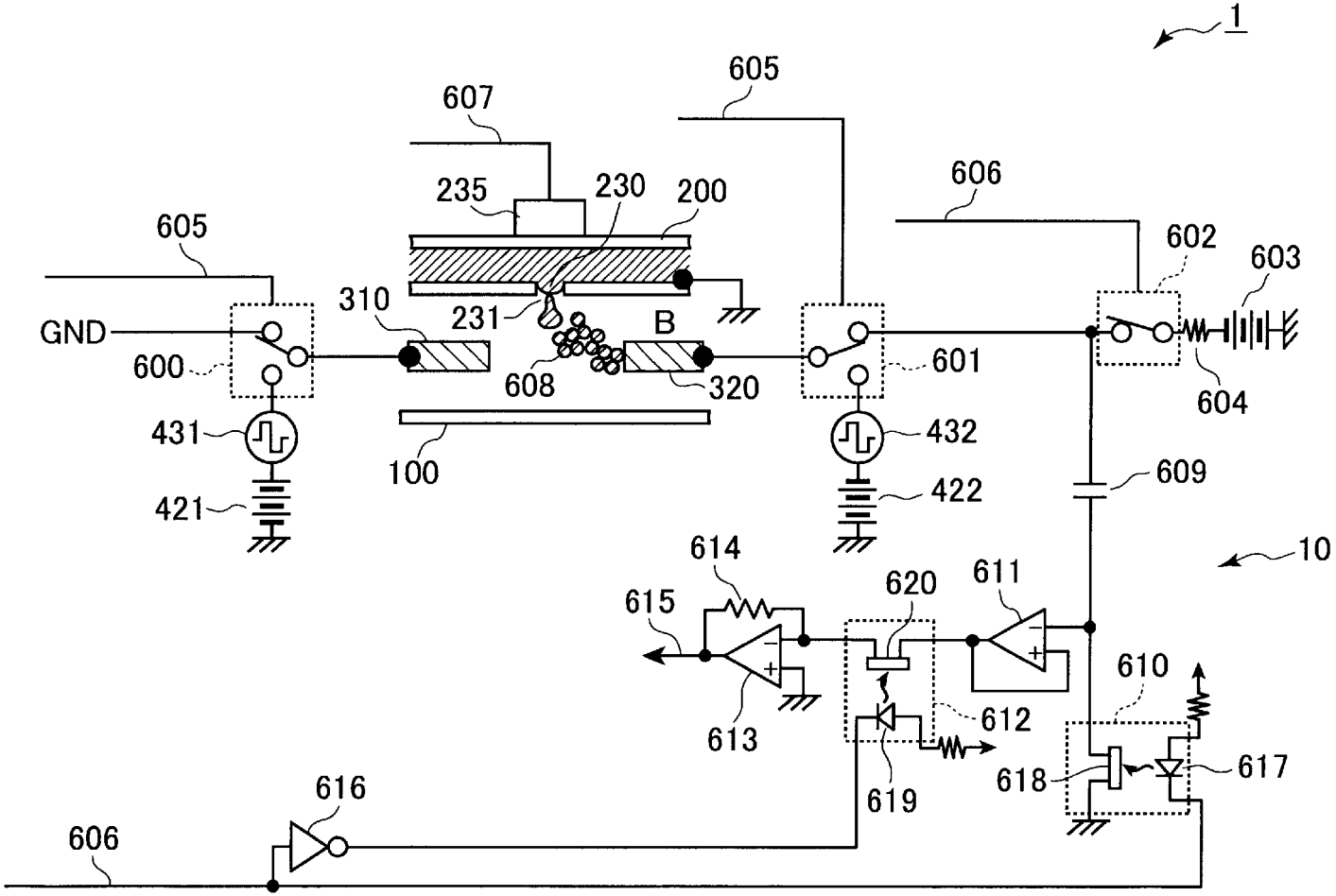
FIG. 1 is a plan view showing a configuration of an ink jet printer according to an embodiment of the present invention.

The ink jet printer 1 shown in FIG. 1 has a print mode and a detect mode. The print mode is for printing operation for forming images on a recording medium. The detect mode is for detecting any nozzle that has became defective. The detect mode is automatically set when a main power of the ink jet printer 1 is turned ON, or once every hour or once every 1,000 pages printing, for example. Needless to say, the detect mode can be manually set as desired or can be set both manually and automatically.

The detect mode includes a charging mode for charging operation and a detection mode for detection operation. Typically, the charging operation and the detection operation together require 1 ms. Performing these two operations twice (2 ms) improves detection precision.

First, the printing operation in the print mode will be described while also explaining a configuration of the ink jet printer 1.

Figure 3:
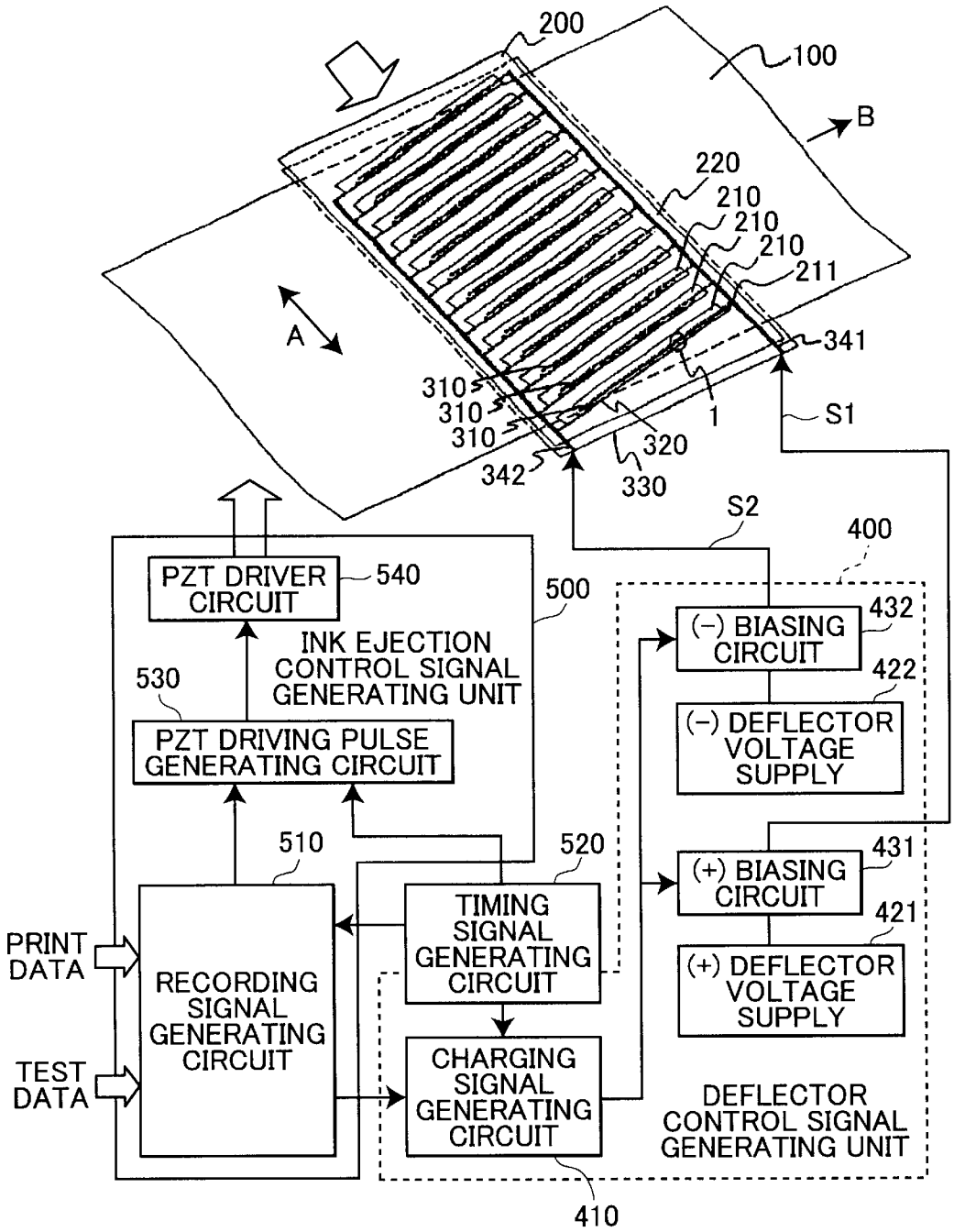
FIG. 3 is a plan view of components, partially indicated in a block diagram, of the ink jet printer.

The ink jet printer 1 of the present embodiment forms an image on an elongated uncut recording sheet 100 of FIG. 3. Specifically, the elongated uncut recording sheet 100 has a width in a first direction A and a length in a second direction B perpendicular to the first direction A, and is transported in the second direction B at a predetermined speed. The ink jet printer 1 forms dots on scanning lines 110 (FIG. 4) on the recording sheet 100 at a dot density of DS so as to form a dot image on the recording sheet 100 at a high speed.

Figure 4:
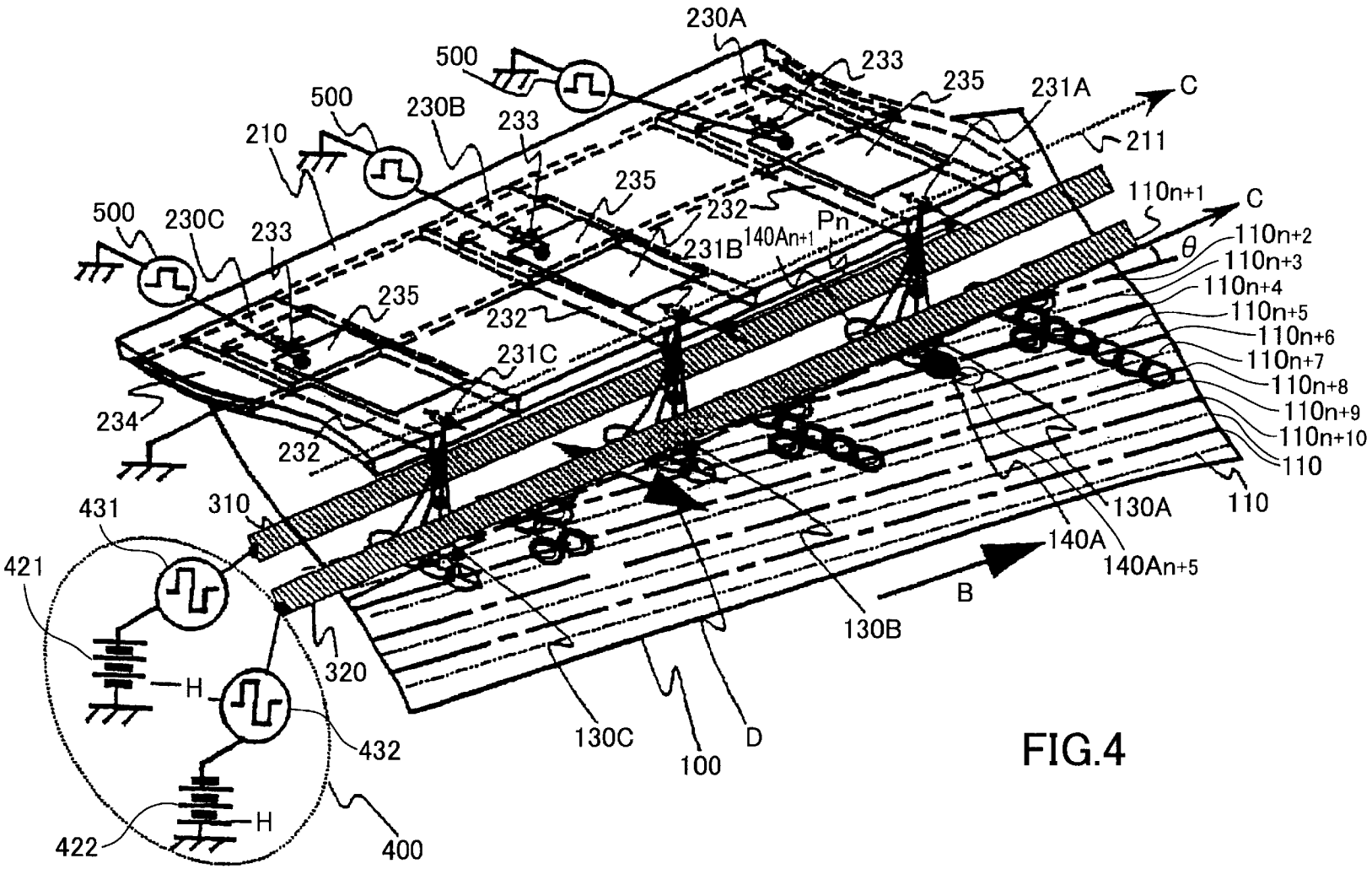
FIG. 4 is a magnified view of component of FIG. 3.

As shown in FIGS. 3 and 4, the ink jet printer 1 includes a recording head 200, which includes a plurality of head modules 210 arranged in the first direction A and a frame 220 for supporting the head modules 210. Each head module 210 has the same configuration, and is formed with a nozzle line 211 extending in a third direction C. The nozzle line 211 includes N nozzles 230 aligned in the third direction C at a pitch of Pn, and each nozzle 230 has a nozzle hole 231 opened to a nozzle surface of the head module 210. The recording head 200 is positioned so that the nozzle surface faces a recording surface of the recording sheet 100 while keeping the distance of 1 mm through 2 mm therebetween.

As shown in FIG. 4, each nozzle 230 has the same configuration and has an ink chamber 232 with the nozzle hole 231, an ink supply port 233 for introducing ink into the ink chamber 232. The head module 210 is formed also with a manifold 234 for distributing ink to the ink supply port 233 of each nozzle 230. The ink chamber 232 is provided with a piezoelectric element 235, such as PZT, serving as an actuator. The piezoelectric element 235 changes a volume of the ink chamber 232 when applied with recording signals.

In the present example, scanning lines 110 extend in the second direction B and have a line density DS of 300 dpi in the first direction A. The angle θ of the third direction C with respect to the second direction B is approximately 11.3 degrees ($=\tan^{-1}(1/5)$). The nozzle-hole pitch Pn is $2/300\,(\sin(1/5))^{-1}$ inches, i.e., approximately 0.034 inches. The number N of nozzles 230 is 96. 13 head modules 210 are used, which is sufficient for covering over the entire width of recording head 200.

The ink jet printer 1 also includes a plurality of pairs of deflector electrodes 310, 320, an electrode substrate 330, a deflection-control-signal generating unit 400, and an ink-ejection control-signal generating unit 500. Each pair of electrodes 310, 320 are provided between the recording sheet 100 and the recording head 200 and sandwich a corresponding one of the nozzle lines 211 therebetween. The electrode 310 serves as a positive-polarity deflector electrode, and the electrode 320 serves as a negative-polarity deflector electrode. The electrodes 310, 320 are connected to a positive-polarity deflector-electrode terminal 341 and a negative-polarity deflector-electrode terminal 342, respectively, which are provided on the electrode substrate 330.

The deflection-control-signal generating unit 400 is for applying deflection control signals to the deflector electrodes 310, 320, and includes a charging-signal generating unit 410, a positive-polarity deflector voltage supply 421, a negative-polarity deflector voltage supply 422, a positive-polarity biasing circuit 431, and a negative-polarity biasing circuit 432.

The charging-signal generating unit 410 generates charging signal voltage for charging ink droplets. The positive-polarity deflector voltage supply 421 and the negative-polarity deflector voltage supply 422 generate and output deflector voltages. The positive-polarity biasing circuit 431 and the negative-polarity biasing circuit 432 superimpose the charging signal voltage onto the deflector voltage, thereby generating charging-deflecting control signals S1, S2, which are applied to the electrodes 310, 320, respectively.

The ink-ejection control-signal generating unit 500 includes a recording-signal generating circuit 510, a timing-signal generating circuit 520, a PZT-driving-pulse generating circuit 530, and a PZT driver circuit 540. The recording-signal generating circuit 510 generates pixel data of images based on input data or test pattern data. The timing-signal generating circuit 520 generates a timing signal for determining operation timings of the ink jet printer 1. The PZT-driving-pulse generating circuit 530 generates a PZT driving pulse for each nozzle 230 based on the pixel data and the timing signal. The PZT driving pulse is for controlling the proper ink ejecting timing. The PZT-driver circuit 540 amplifies the PZT driving pulse to a signal level sufficient for driving the piezoelectric element 235, and outputs the amplified PZT driving pulse to the piezoelectric element 235 of each nozzle 230, so that an ink droplet is ejected from the nozzle 230 at a proper timing. The timing-signal generating circuit 520 also generates print-mode/detect-mode switching signals 605, charging-mode/detection-mode switching signals 606, and ejection signals 607 as described later.

Figure 6:
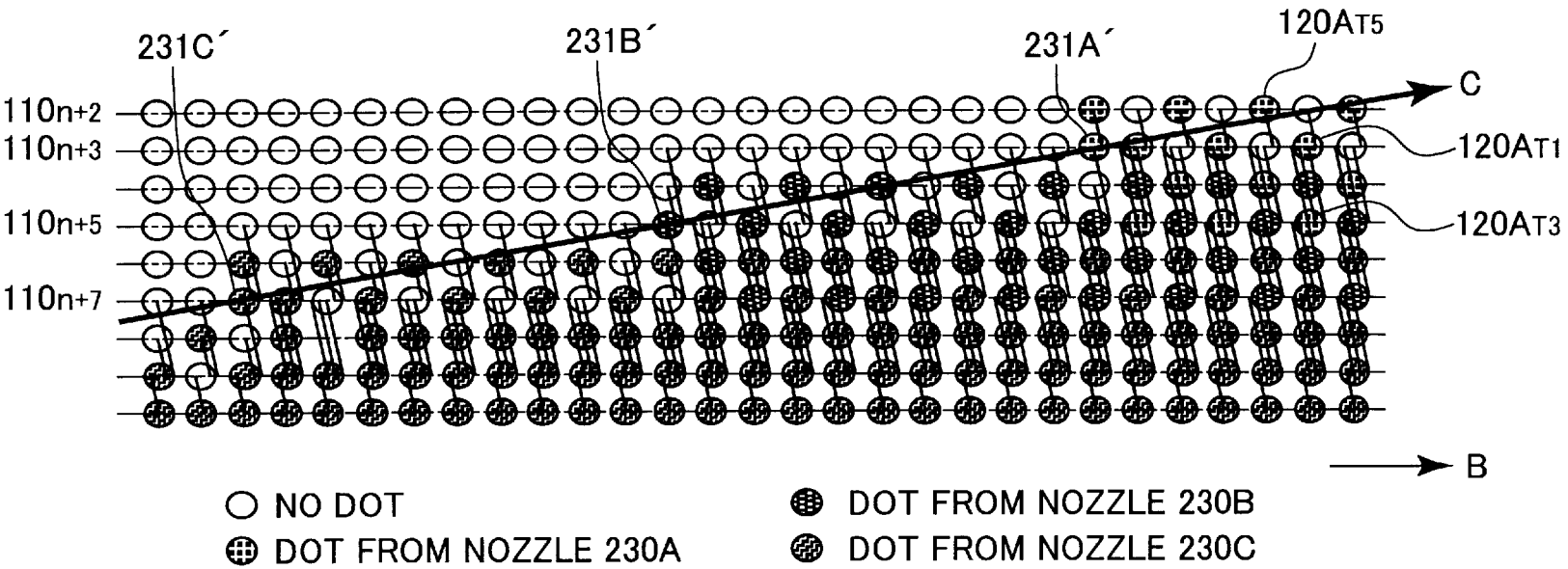
FIG. 6 is an explanatory view showing dots formed on a recording sheet.

FIG. 5(*a*) shows the charging-deflecting control signals S1 and S2 applied to the electrodes 310 and 320, respectively. FIG. 5(*b*) shows PZT driving pulses Sa through Sd for each nozzle 230 and also corresponding ink-droplet deflection amounts Ca through Cd. FIG. 6 shows dots recorded on the recording sheet 100. Details will be described next.

When the electrode 310 for a positive polarity is applied with the charging-deflecting control signals S1, a deflector voltage of +H and a charger voltage are applied to the electrode 310. Similarly, when the electrode 320 for a negative polarity is applied with the charging-deflecting control signals S2, a deflector voltage of −H and the charger voltage are applied to the electrode 320. The magnitude of the charger voltage changes every time period T in a stepped manner among 0 V and ± Vc. As a result, a charger electric field for charging ink droplets and a deflector electrostatic field for deflecting the charged ink droplets are generated.

The ink held in the recording head 200 is electrically connected to the ground, i.e., has OV. Therefore, at the time when the ink droplet 130 is about to be ejected from the nozzle hole 231, the charger voltage is applied between the ink droplet 130 and the electrodes 310, 320. Because the ink has an excellent conductivity of lower than several hundreds Ω cm, at the time of when the ink droplet 130 separates from the rest of the ink, the ink droplet 130 is charged by an amount corresponding to the charger voltage applied at that moment. Then, the charged ink droplet 130 flies toward the recording sheet 100. Before impacting on the recording sheet 100, the ink droplet 130 is deflected by the deflector electrostatic field by a deflection amount in proportion to the charged amount toward a fourth direction D perpendicular to the third direction C (FIG. 4).

Referring to FIG. 4, an ink droplet 130A ejected from a nozzle hole 231A can impact on any scanning lines $\mathbf{110}_{n+1}$ to $\mathbf{110}_{n+5}$ depending on its deflection amount, and therefore can form any dot $\mathbf{140}_{AN+1}$ to $\mathbf{140}_{AN+5}$. Similarly, an ink droplet 130B ejected from a nozzle hole 231B can impact on any scanning lines $\mathbf{110}_{n+3}$ to $\mathbf{110}_{n+7}$ by deflection, and an ink droplet 130C from a nozzle hole 231C is deflected to impact on any scanning lines $\mathbf{110}_{n+5}$ to $\mathbf{110}_{n+9}$. That is, the ink droplets 130A, 130B, 130C from three different nozzle holes 231A, 231B, and 231C can impact on the single scanning line $\mathbf{110}_{n+5}$. Also, two ink droplets from different nozzle holes can impact on the scanning line $\mathbf{110}_{n+4}$. The same is true for the scanning line $\mathbf{110}_{n+6}$.

The recording operations will be described further in more detail. It should be noted that as described above the PZT driving pulses Sa through Sd of FIG. 5(*b*) are applied to the piezoelectric elements 235 for ejecting ink droplets 130. FIG. 6 shows dots formed on the recording sheet 100 and projections 231A', 231B', 231C' of the nozzle holes 231A, 231B, 231C of FIG. 4. The line segments extending perpendicular to the direction C are time division/deflection reference lines L. The interval of the reference lines L indicates the time interval T, the direction of the reference lines L indicate a direction of the deflection, and the length of the reference lines L indicates the deflection amount.

As shown in FIGS. 5(*a*) and 5(*b*), at the time T1, the charger voltage is ±0. Accordingly, the ink droplet 130A ejected from the nozzle hole 213A at the time T1 is not charged. Accordingly, the ink droplet 130A is not deflected but flies straight, and then impacts on, for example, a pixel $\mathbf{120}A_{T1}$ on the scanning line $\mathbf{110}_{n+3}$ of FIG. 6, forming a dot thereon. At a subsequent time T2, because the PZE driving signal pulse is not applied to the piezoelectric element 235 of the nozzle 230A, no ink droplet is ejected at the time T2, and so not dot is formed. At the time T3, the charger voltage is −Vc, so an ink droplet ejected at the time T3 is deflected by an amount of −2. The ink droplet impacts on a pixel $\mathbf{120}A_{T3}$ on the scanning line $\mathbf{110}_{n+5}$, and forms a dot thereon. At the time T4, no dot is formed by an ink droplet from the nozzle hole 231A. At the time T5, the charger voltage is +½ Vc, so an ink droplet ejected at the time T5 is deflected by an amount of +1. The ink droplet impacts on a pixel $\mathbf{120}A_{T5}$ on the scanning line $\mathbf{110}_{n+2}$, and forms a dot thereon. The same operation is performed with respect to the nozzle-holes 231B, 231C, 231D, and on, so that dots are formed on other pixels also as shown in FIG. 6.

In this manner, ink droplets 130A ejected from the nozzle hole 231A are selectively deflected and able to impact on every pixel on the five scanning lines $\mathbf{110}_{n+1}$ through $\mathbf{110}_{n+5}$.

Next, the operation in the detect mode will be described while referring to a monitoring mechanism of the ink jet printer 1.

It is assumed in this example that the nozzle 230 shown in FIG. 1 is defective, and an ink droplet 608 that is smaller in size than a proper ink droplet is ejected from the nozzle 230. The nozzle 230 becomes defective for different reasons, for example, when the nozzle 230 is clogged, when air bubbles are trapped in the nozzle 230, or when a portion around the nozzle hole 231 is unevenly wet with ink. In this condition, the defective nozzle is incapable of ejecting ink, or ink droplet is ejected at an angle. Sometimes, an ink droplet is ejected along with additional minute ink droplets.

As shown in FIG. 1, the ink jet, printer 1 further includes a monitoring mechanism 10 provided to each nozzle 230. The monitoring mechanism 10 includes switches 600, 601, and 602, which together determine the operation mode of the ink jet printer 1. For example, the connection conditions shown in FIG. 1 of the switches 600, 601, 602 indicate that the ink jet printer 1 is in the charging mode of the detect mode.

The switches 600 and 601 are connected to the deflector electrodes 310 and 320, respectively, and change their connection condition in response to the print-mode/detect-mode switching signal 605. The switch 602 is turned ON and OFF in response to the charging-mode/detection-mode switching signal 606. Each of the switching signals 605 and 606 are output from the timing-signal generating circuit 520 and takes the value of either "0" or "1".

When the switching signal 605 of "1" is output to the switches 600 and 601, this means that the print mode is selected, the switches 600 and 601 connect the electrodes 310, 320 to the deflection-control-signal generating unit 400.

When setting to the detect mode, the switching signal 605 is switched from "1" to "0", so that the switches 600 and 601 are switched into the connection condition shown in FIG. 1, and the operation mode is switched from the print mode to the detect mode.

When the switching signal 605 is switched to "0" in this manner as shown in FIG. 2(*a*), the switching signal 606 is initially set to "0" as shown in FIG. 2(*f*). As a result, the switch 602 is turned ON as shown in FIGS. 1 and 2(*g*), and the operation mode is set to the charging mode.

In this charging mode, that is, in the condition shown in FIG. 1, the deflector electrode 310 is connected to the ground, that is, set to 0 V (FIG. 2(*c*)). On the other hand, the deflector electrode 320 is connected to a charger voltage supply (battery) 603 via a resister 604 and the switch 602. The charger voltage source 603 supplies a DC voltage of −V1 to the deflector electrode 320 (FIG. 2(*d*). At the same time, a condenser 609 is also charged with −V1 from the charger voltage supply 603 via the resister 604.

The ejection signal 607 shown in FIG. 2(*b*) is output to the piezoelectric element 235. Because the nozzle 230 of FIG. 1 is defective as mentioned above, the minute ink droplets 608 are ejected from the nozzle 230. At this time, the minute ink droplets 608 are positively charged by a charger electric field generated by the deflector electrode 301 with 0 V and the deflector electrode 320 with −V1.

Next, as shown in FIG. 2(*f*), the switching signal 606 is switched to the value of "1", and the operation mode is switched from the charging mode to the detection mode. As a result, the ejection signal 607 is stopped (FIG. 2(*b*)), and the switch 602 is turned OFF (FIG. 2(*g*)). Because no ejection signal 607 is output, no ink droplet is ejected from the nozzle 230. Also, because the switch 602 is turned OFF, the charged voltage of the condenser 609, which is negatively charged during the charging mode, is applied to the deflector electrode 320, so that the second deflector electrode 320 is maintained at −V1 (V) (FIG. 2(*d*)).

Accordingly, the positively charged ink droplets 608 are pulled toward the negatively charged deflector electrode 320 and impact thereon. It should be noted that because an ink droplet in a proper size flies at a higher speed, the positively-charged ink droplet having a proper size does not impact on the deflector electrode 320 but reaches the recording sheet 100. However, because the minute ink droplets 608 are slow in their flying speed, the droplets 608 are pulled toward the deflector electrode 320 during both the charging mode and the detection mode and impact thereon eventually.

When the positively charged ink droplets 608 impacts and cling on the deflector electrode 320, the negative charge of the condenser 609 is canceled out by the positive charge of the ink droplets 608. As a result, the positive charge at a side of the condenser 609 opposite to the side connected to the deflector electrode 320 flows to the ground via a field effect transistor (FET) 618 of a photo-coupler 610. That is, the electric discharge occurs by the amount equivalent to the charging amount of the minute ink droplets 608 clinging on the deflector electrode 320.

The photo-couplers 610 and 612 control the electric current flowing through light-emitting diodes (LEDs) 617 and 619 (input side) so as to control the ON resistance of the FETs 618 and 620 (output side), respectively. The ON resistance can change from tens Ω to hundreds MΩ.

In the detection mode, the switching signal 606 is "1" as mentioned above. Therefore, no electric current flows to the LED 617 of the photo-coupler 610, so that the ON resistance of the photo-coupler 610 is large (FIG. 2(*h*)). Also, because an inverter 616 outputs a signal of "0" to the photo-coupler 612, an electric current flows to the LED 619 of the photo-coupler 612, so that the ON resistance of the FET 620 of the photo-coupler 612 is small (FIG. 2(*i*)).

Accordingly, the discharge due to the charged minute ink droplets 608 is detected as a large detection voltage at the both sides of the FET portion 618, impedance-converted at the operation amplifier 611, amplified at an operation amplifier 613 at an amplification rate, which is determined by the resistance of the resister 614 and the ON resistance of the FET portion 620, and so producing a detection output 615 (FIG. 2(*e*)). That is, the detection output 615 is amplified at a high rate in the detection mode. Because the charger voltage of the condenser 609 is static and has no noise, even when the detection output 615 is amplified at the high rate, the noise during the detection is greatly suppressed.

On the other hand, when the switching signal 606 is "0" in the charging mode, the ON resistance of the photo-coupler 610 is small, and the ON resistance of the FET 620 is large, so that the amplification rate is small.

In this way, because stable and low noised deflector DC voltage is used over the charging period in the charging mode to the detection period in the detection mode, and also because the voltage is controlled to the lower amplification rate at the charging period and to the higher amplification rate in the detection period, the detection output 615 with a high SNR can be obtained.

By performing the above charging operation and detection operations twice, the detection precision is enhanced as mentioned above. In other words, in the detect mode, the ejection signal 607 are intermittently output, and a defective nozzle is detected based on the discharge due to the ink droplets impacted on the electrodes 320 at the time of when the ejection signal 607 is not output. The electrode 320 is applied with a negative voltage from the battery 603 and the condenser 609 in the detect mode.

While some exemplary embodiments of this invention have been described in detail, those skilled in the art will recognize that there are many possible modifications and variations which may be made in these exemplary embodiments while yet retaining many of the novel features and advantages of the invention.

What is claimed is:

1. An ink jet recording device comprising:

a head formed with a nozzle for selectively ejecting an ink droplet from the nozzle;

a deflecting means for deflecting the ink droplet ejected from the nozzle, the deflecting means including a first electrode and a second electrode;

a mode selecting means for selecting one of a first mode and a second mode;

an applying means for applying a direct voltage to the first electrode and another direct voltage to the second electrode throughout the first mode and the second mode, the direct voltage differing from the another direct voltage; and a detection means for detecting a quantity of electricity relating to an electric discharge flowing through the first electrode in the second mode, the discharge current being caused by ink droplets clinging onto the first electrode.

2. The ink jet recording device according to claim 1, further comprising a control means for controlling the head to eject ink droplets in the first mode and not to eject ink droplets in the second mode.

3. The ink jet recording device according to claim 2, wherein the head is formed with a nozzle line including a plurality of nozzles and selectively ejects ink droplets from the nozzles.

4. The ink jet recording device according to claim 1, wherein the applying means includes a condenser that applies the direct voltage to the first electrode.

5. The ink jet recording device according to claim 4, wherein the condenser has a first side and a second side, the first side being electrically connected to the first electrode, the second side being electrically connected to the ground, and the detection means detects a current discharged from the condenser caused by the ink droplets impinging on the first electrode.

6. The ink jet recording device according to claim 1, wherein the applying means includes a battery that applies the direct voltage to the first electrode.

7. The ink jet recording device according to claim 1, wherein the applying means includes a battery and a condenser, the battery applying a first voltage of the direct voltage to the first electrode in the first mode, the condenser applying a second voltage of the direct voltage to the first electrode in the second mode.

8. The ink jet recording device according to claim 7, further comprising a control means for controlling the head to eject ink droplets in the first mode and not to eject ink droplets in the second mode.

9. The ink jet recording device according to claim 8, wherein the mode selecting means selects one of the first mode, the second mode, and a third mode, and the control means controls the head and the deflecting means in response to a print data to form an image corresponding to the print data on a recording medium in the third mode.

10. The ink jet recording device according claim 7, wherein:

the condenser has a first side and a second side, the first side being electrically connected to the first electrode and the battery, the second side being electrically connected to the ground;

the battery charges the condenser in the first mode; and the detection means detects a current discharged from the condenser caused by the ink droplets on the first electrode.

11. The ink jet recording device according to claim 1, further comprising an amplifying means for amplifying the quantity of electricity at an amplifying rate, and a rate setting means for setting the amplifying rate to a first rate in the first mode and to a second rate in the second mode, the first rate being lower than the second rate.

12. A control method for controlling an ink jet recording device, comprising the steps of:

a) selecting a first mode;

b) applying a direct voltage to a first electrode and another direct voltage to a second electrode throughout the first mode and a second mode, the direct voltage differing from the another direct voltage;

c) ejecting an ink droplet from a nozzle of an ink jet head in the first mode;

d) switching from the first mode to the second mode; and e) detecting a quantity of electricity relating to an electric discharge flowing through the first electrode, the electric discharge being caused by ink droplets clinging onto the first electrode.

13. The control method according to claim 12, wherein the quantity of the electric discharge caused by ink droplets clinging onto the first electrode is detected in the step e).

14. The control method according to claim 12, wherein the direct voltage applied to the first electrode in the step b) is applied from a battery.

15. The control method according to claim 12, wherein the direct voltage applied to the first electrode in the step b) is applied from a condenser.

16. The control method according to claim 12, wherein in the step b) a first voltage of the direct voltage is applied from a battery in the first mode, and a second voltage of the first voltage is applied from a condenser in the second mode.

17. The control method according to claim 16, wherein the quantity of the electric discharge caused by ink droplets clinging onto the first electrode is detected in the step e).

18. The control method according to claim 12, further comprising the step of f) switching from the second mode to a third mode for forming an image corresponding to print data on a recording medium.

19. The control method according to claim 12, further comprising the steps of g) amplifying the quantity of electricity at a first amplifying rate in the first mode, and h) amplifying the quantity of electricity at a second amplifying rate greater than the first amplifying rate in the second mode.

20. The control method according to claim 12, wherein the steps a) through e) are repeatedly performed.

* * * * *